US006575842B2

(12) United States Patent
Tidwell

(10) Patent No.: US 6,575,842 B2
(45) Date of Patent: Jun. 10, 2003

(54) PUTTING AND CHIPPING TRAINING KIT

(76) Inventor: David Tidwell, 12000 Brodie La., Austin, TX (US) 78748

( * ) Notice: Subject to any disclaimer, the term of this patent is extended or adjusted under 35 U.S.C. 154(b) by 0 days.

(21) Appl. No.: 09/965,257

(22) Filed: Sep. 28, 2001

(65) Prior Publication Data

US 2003/0064819 A1 Apr. 3, 2003

(51) Int. Cl.[7] ..... A63B 69/36

(52) U.S. Cl. ..... 473/180; 473/172; 473/196; 473/353; 473/165

(58) Field of Search ..... 473/157–159, 473/162, 172, 173, 174, 180–189, 196, 353

(56) References Cited

U.S. PATENT DOCUMENTS

| | | | | | |
|---|---|---|---|---|---|
| 1,637,407 | A | * | 8/1927 | Brumder | 473/184 |
| 3,464,703 | A | * | 9/1969 | Vallas | 473/158 |
| 3,649,027 | A | * | 3/1972 | Vallas | 473/169 |
| 3,700,243 | A | * | 10/1972 | Kenney | 206/315.9 |
| 3,918,719 | A | * | 11/1975 | Welch | 273/DIG. 24 |
| 4,695,055 | A | | 9/1987 | Newcomb et al. | |
| 4,761,009 | A | | 8/1988 | Gibree | |
| 4,878,671 | A | * | 11/1989 | Gubany | 473/172 |
| 4,913,437 | A | * | 4/1990 | Newcomb et al. | 273/DIG. 24 |
| 5,163,684 | A | | 11/1992 | Seidler | |
| 5,741,194 | A | * | 4/1998 | Simunek | 473/490 |
| 5,818,036 | A | | 10/1998 | Daly | |
| 5,857,919 | A | * | 1/1999 | Hoyt et al. | 473/179 |
| 5,938,537 | A | | 8/1999 | Liv | |
| 5,989,135 | A | | 11/1999 | Welch | |
| 6,213,887 | B1 | | 4/2001 | Carney | |
| 6,257,995 | B1 | | 7/2001 | Shrimmer et al. | |

FOREIGN PATENT DOCUMENTS

| | | | |
|---|---|---|---|
| WO | WO89/01810 | * | 3/1989 |

* cited by examiner

*Primary Examiner*—Mark S. Graham
(74) *Attorney, Agent, or Firm*—Joseph F. Long

(57) ABSTRACT

A kit containing all the materials necessary to assemble a putting and chipping training unit that may be used in total darkness since a putting cup, golf balls, and direction labels for a golf club head are all equipped with phosphoric markings that glow in the dark for about eight hours before recharging is necessary by light exposure.

2 Claims, 1 Drawing Sheet

PUTTING AND CHIPPING TRAINING KIT

BACKGROUND OF THE INVENTION

Disclosure document 4958998 was mailed to the patent office on Jun. 10, 2001 under the title "Nytevision Golf Concentration Trainer."

We found numerous patent documents relating to equipment and training methods to train people to be better golfers. We found none with all the equipment necessary to allow a person to train on putting and chipping in total darkness. The kit of this invention is designed to allow training in total darkness. Users aver that training with using elements of this kit in darkness has improved their performance on an actual green.

The kit contains a putting cup held in a solid base that may be plastic, wood, or possibly metal with finished oak being preferred. The top of the putting cup has ring a containing phosphoric material and will glow in the dark for about eight hours before it must be reactivated by exposure to light. The putting cup holder has a slope leading to the putting cup. The slope is the necessary steepness that a ball should enter the slope at a speed that is about a 12 on a stent meter for the ball to travel up the slope and fall into the putting cup. Said another way, the ball on a missed putt would have enough speed to roll 12 to 18 inches past the hole. Apparently this is the most desirable speed for a ball to approach the cup.

The kit normally contains four golf balls but would have a minimum of one. Each ball in the kit would have two phosphoric ink spots about ⅜ of an inch in diameter located directly opposite each other on each golf ball. The kit also would normally contain four adhesive labels with a phosphoric direction marker such as an arrow. The labels would be sized and shaped to allow labelling a golf club head to indicate when the club is properly aligned.

All materials necessary to allow one to practice in darkness are in the kit.

SUMMARY OF THE INVENTION

The invention comprises a kit that may be packaged in a small square box about two inches deep. The kit contains a regulation sized 4 and ½ inch putting cup, four golf balls, and direction indicating labels for use on a golf club head. The putting cup has a plastic top ring with phosphoric material therein so that the ring will glow for about eight hours before reactivation by exposure to light is necessary. Similary each golf ball has two phosphoric spots that glow and reactivate and each of at least two labels has an phosphoric direction indicator thereon. The solid container that holds the putting cup has a sloping portion leading to the putting cup. The slope is such that a ball that enters the bottom of the slope with just enough speed to fall into the putting cup has the same speed attained by a missed put on a normal green that rolls 12 to 18 inches past the hole.

DETAILED DESCRIPTION OF THE INVENTION

Figure 1:
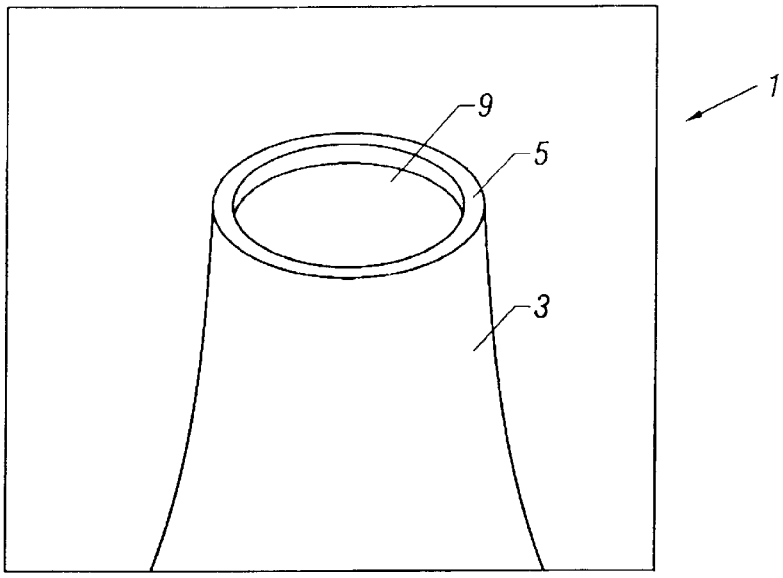
FIG. 1 Putting and Chipping cup holding unit
Figure 2:
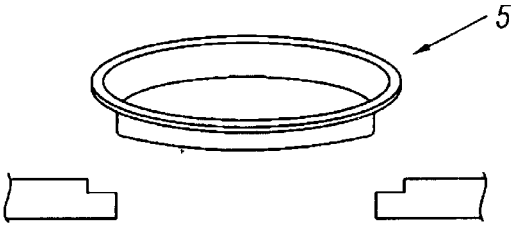
FIG. 2 Putting ring showing fit in the putting and chipping cup

The easy way to describe the invention is from the drawings. In FIG. 1 the putting cup holder is 1. A top view of the putting cup 9 is shown with a glowing ring 5. More detail of the glowing ring is shown in FIG. 2. A slope 3 starts with about one sixteenth inch edge and is sloped upward to the putting and chipping cup 9. The upward slope is such that if a ball has the proper speed that it will just roll into the cup when the ball reaches the bottom of the slope. The ball is rolling at a speed such that on a normal greens the ball would roll from 12 to 18 inches past the cup on a missed putt attempt.

In FIG. 2 the body of the ring 5 is about ¼ by ¼ inch square in cross section with an upper edge ⅛ inch thick and about ⅜ inches wide and sized to fit the regulation 4 and ½ inch sized putting cup. The cup is manufactured using a plastic containing a phosphoric material. As manufactured the cup will glow for about eight hours following exposure to light. Exposure to daylight, sunlight or artificial light will reactivate the glowing property of the unit.

Figure 3:
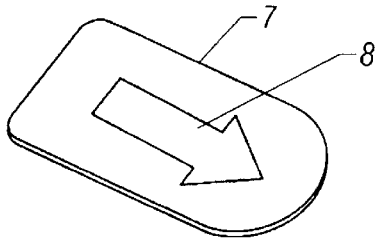
FIG. 3 Putter and Chipper golf club label

FIG. 3 shows an adhesive label 7 that has a direction indicator such as the arrow shown that is made with an ink containing a phosphoric compound such that the arrow will glow for about eight hours following exposure to light. Re-exposure to light will reactivate the ink to again glow for about eight hours. One of the adhesive labels 7 may be placed on a putter or chipping club by the user to aid his use in darkness.

Figure 4:
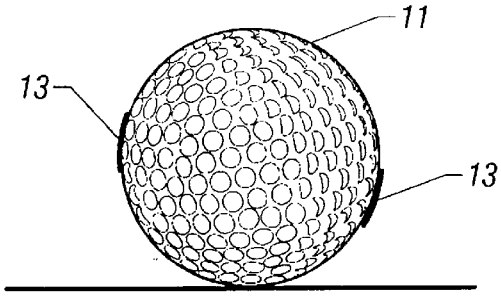
FIG. 4 Golf ball with glow spots

FIG. 4 shows a golf ball 11 that has two phosphoric ink spots 13 with one on either side of the ball.

With the label on the golf club head, glowing spots on the golf balls and a glowing ring on the putter cup it is quite possible and indeed is preferable that a user may practice in total darkness. Users practicing in darkness aver that this has improved their concentration and their actual performance on the normal putting green.

Although not shown, all the materials including four marked balls may placed in the putting cup and a supply of labels may be placed in the putting cup so that the total unit may be transported in about a 10 by 10 by 2 inch deep box.

What is claimed is:

1. A putting and chipping practice kit comprising a) a putting cup held in a solid container, b) a putting cup ring containing a phosphoric material sized to fit in a top of said putting cup;

c) a sloping approach in said solid container holding said putting cup; said sloping approach having a slope such that a ball rolling just fast enough to roll into said cup would be rolling at the same speed as a missed putt on a normal green that rolled 12 to 18 inches past the cup;

d) four golf balls, each of said four golf balls having two phosphoric ink spots directly opposite each other;

e) a minimum of four adhesive labels, each of said labels having a direction indicator made with phosphoric ink and each sized to fit on a golf club head.

2. A putting and chipping practice kit comprising a) a 10 by 10 by 2 inch box, b) a putting cup held in a solid container, c) a putting cup ring containing a phosphoric material sized to fit in a top of said putting cup;

d) a sloping approach in said solid container holding said putting cup; said sloping approach having a slope such that a ball rolling just fast enough to roll into said cup would be rolling at the same speed as a missed putt on a normal green that rolled 12 to 18 inches past the cup;

e) four golf balls, each of said four golf balls having two phosphoric ink spots directly opposite each other;

f) a minimum of four adhesive labels, each of said labels having a direction indicator made with phosphoric ink and each sized to fit on a golf club head.

* * * * *